United States Patent [19]

Salah

[11] 4,253,169

[45] Feb. 24, 1981

[54] ELECTRONIC CALCULATION WATCH WITH DIGITAL DISPLAY

[76] Inventor: Ibrahim M. Salah, Salzhausstrzusse 7, 2503 Biel, Switzerland

[21] Appl. No.: 875,892

[22] Filed: Feb. 7, 1978

[30] Foreign Application Priority Data

Feb. 10, 1977 [CH] Switzerland ..... 68694

[51] Int. Cl.[3] ..... G04B 19/26

[52] U.S. Cl. ..... 368/15; 368/17; 368/21; 368/22; 368/28; 368/29

[58] Field of Search ..... 58/42.5, 43, 44, 3, 58/23 R, 50 R, 85.5, 127 R; 368/15, 17, 21, 22, 28, 29

[56] References Cited

U.S. PATENT DOCUMENTS

| | | | |
|---|---|---|---|
| 3,653,204 | 4/1972 | Mina | 58/42.5 |
| 3,940,920 | 3/1976 | Nakamura et al. | 58/42.5 |
| 4,044,545 | 8/1977 | Shimizu | 58/42.5 |
| 4,072,005 | 2/1978 | Teshima et al. | 58/42.5 |
| 4,133,170 | 1/1979 | Kashio | 58/42.5 |

*Primary Examiner*—Ulysses Weldon

*Attorney, Agent, or Firm*—Allegretti, Newitt, Witcoff & McAndrews

[57] ABSTRACT

An electronic watch with circuitry to calculate and display time under the Moslem calendar.

11 Claims, 16 Drawing Figures

HOUR TRANSCODER $A' = A$ $B' = B\overline{D} + \overline{A}\cdot\overline{B}\cdot\overline{C}\cdot\overline{D}$ $C' = C$ $D' = D\cdot\overline{B}$ $A'' = D\cdot B + \overline{A}\cdot\overline{B}\cdot\overline{C}\cdot D$

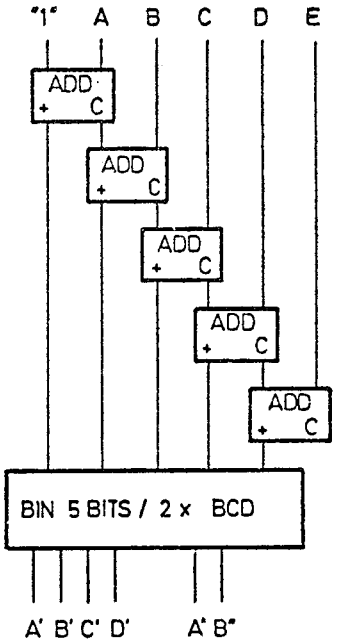
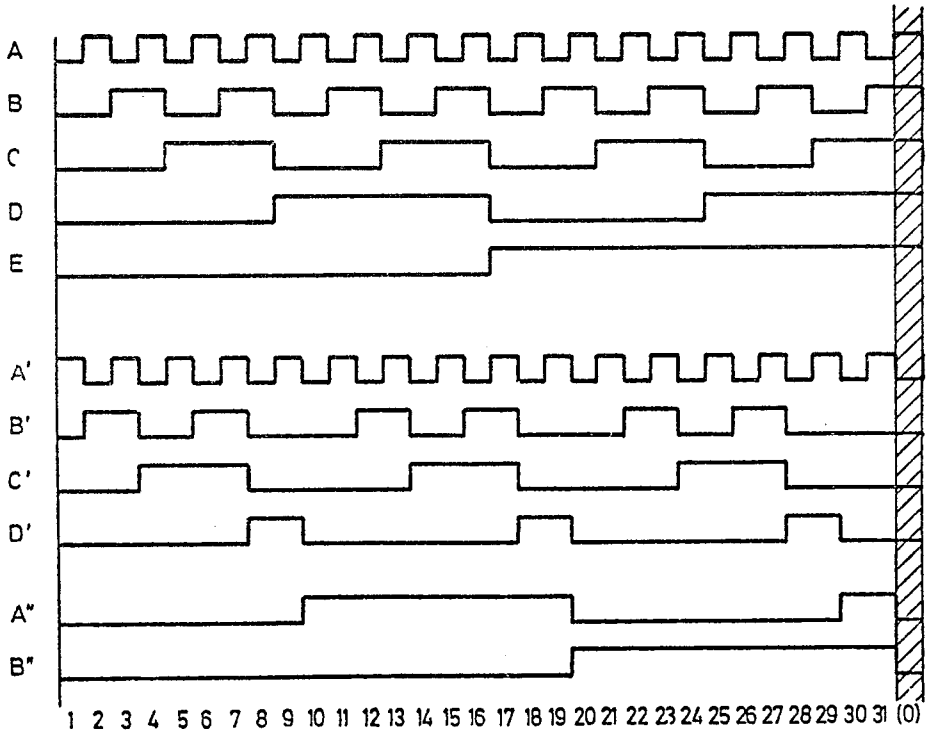
FIG. 9 DAY OF MONTH TRANSCODER + 30 YEAR CYCLE

ELECTRONIC CALCULATION WATCH WITH DIGITAL DISPLAY

This invention relates to electronic watches, particularly to an electronic wrist watch of the type having a digital display and comprising means for calculating and displaying the time.

A great many types of digital-display electronic watches have already been proposed, especially digital-display electronic wrist watches, equipped with various improvements and performing the functions of a chronograph, an alarm, a reminder, etc. On the other hand, there has hitherto never been manufactured, or even simply proposed, an electronic watch of this type which is particularly suited to the needs of the adherents of Islam, i.e., the Moslems. Yet the rites of the Moslem religion are governed by a number of principles quite closely related to the measurement of time, be it the time of day, the time of the (lunar) month, or the time of the year (or season). The calculations used to establish the precise moments of the Moslem calendar and the precise limits of daily times of prayer are relatively complicated, and the tables giving these indications must contain a great many data if it is desired to compile relatively reliable indications for most of the inhabited world. Until now, it had not occurred to anyone to have these indications calculated and supplied by the electronic circuitry of a digital-display wrist watch, even through this would be a great convenience for the adherents of Islam. It seems that those skilled in the art have heretofore been of the opinion that it was practically not possible, owing to the complexity, to introduce this entire "science" into the circuits of a wrist watch.

It is therefore an object of this invention to provide a digital electronic watch, particularly in the form of a wrist watch, which is capable of determining and displaying most of the elements in question which are useful to Moslems and which they are presently obliged to look up in almanacs.

To this end, there is provided according to the present invention an electronic timepiece, particularly an electronic wrist watch, having a digital display and comprising means for displaying information relative to particular positions of the sun which correspond especially to Moslem customs and practices.

Figure 1:
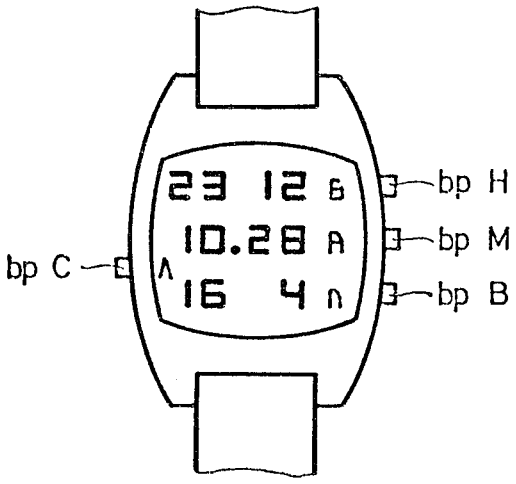
Figure 2:
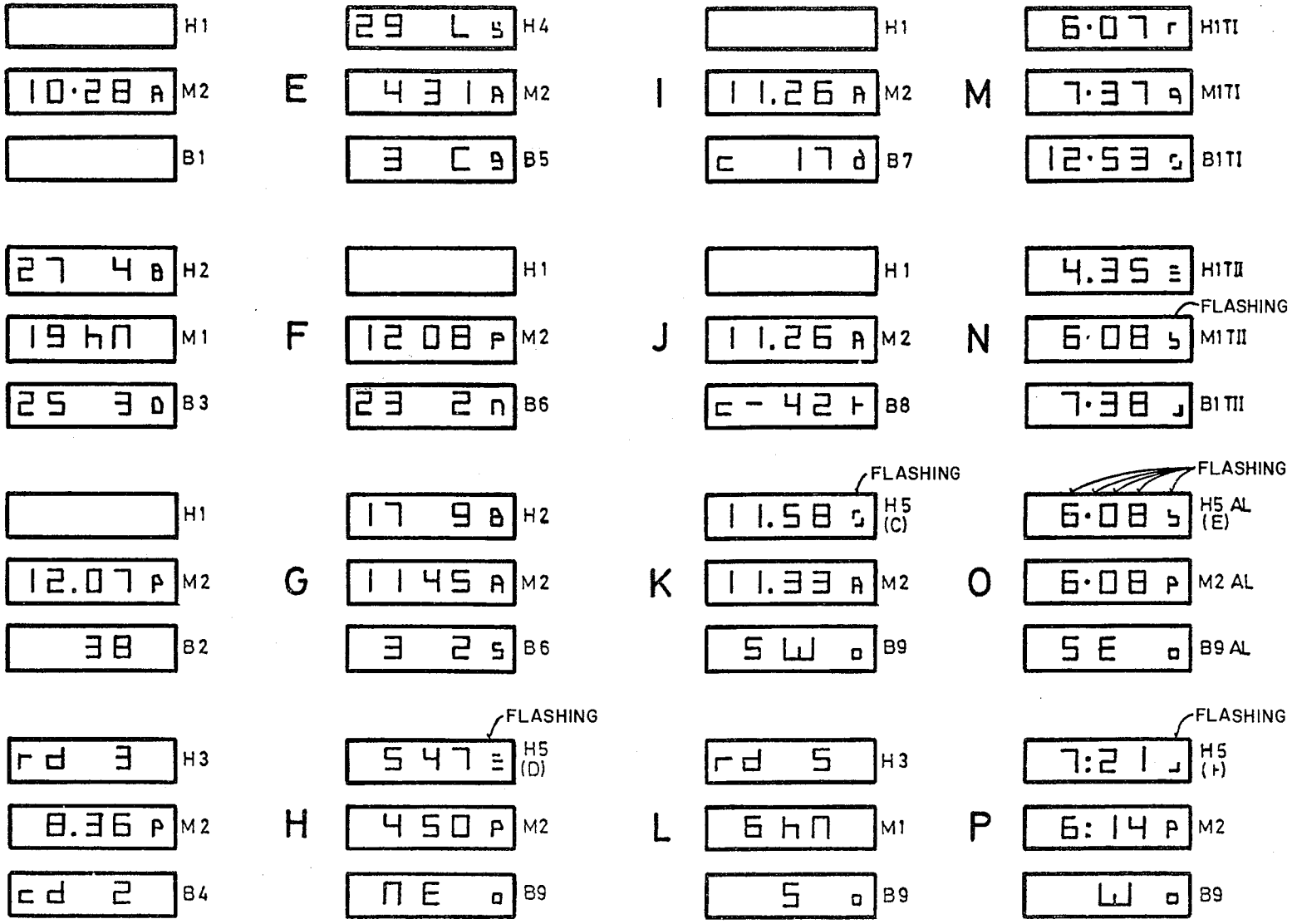
Figure 3:
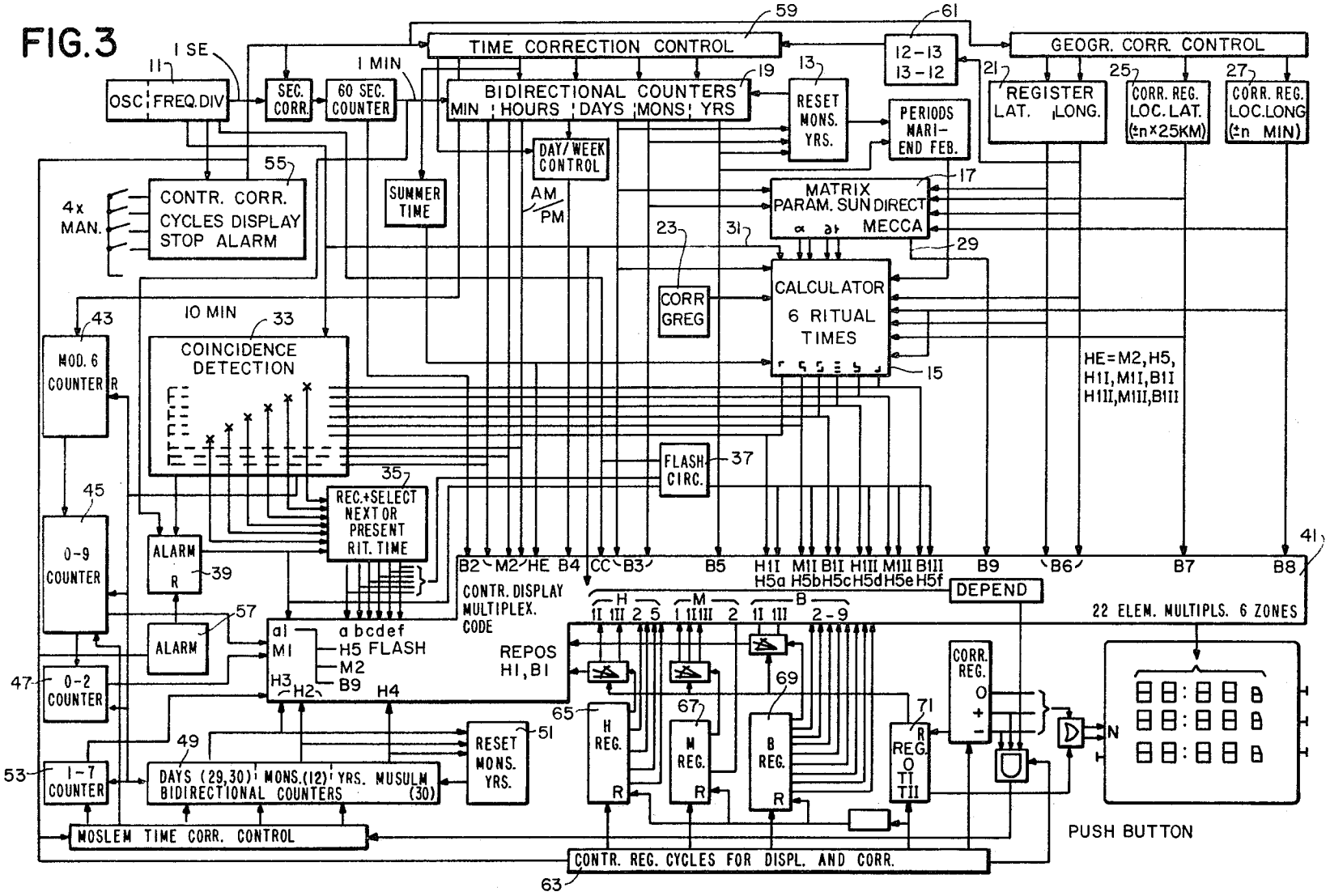
Figure 4A:
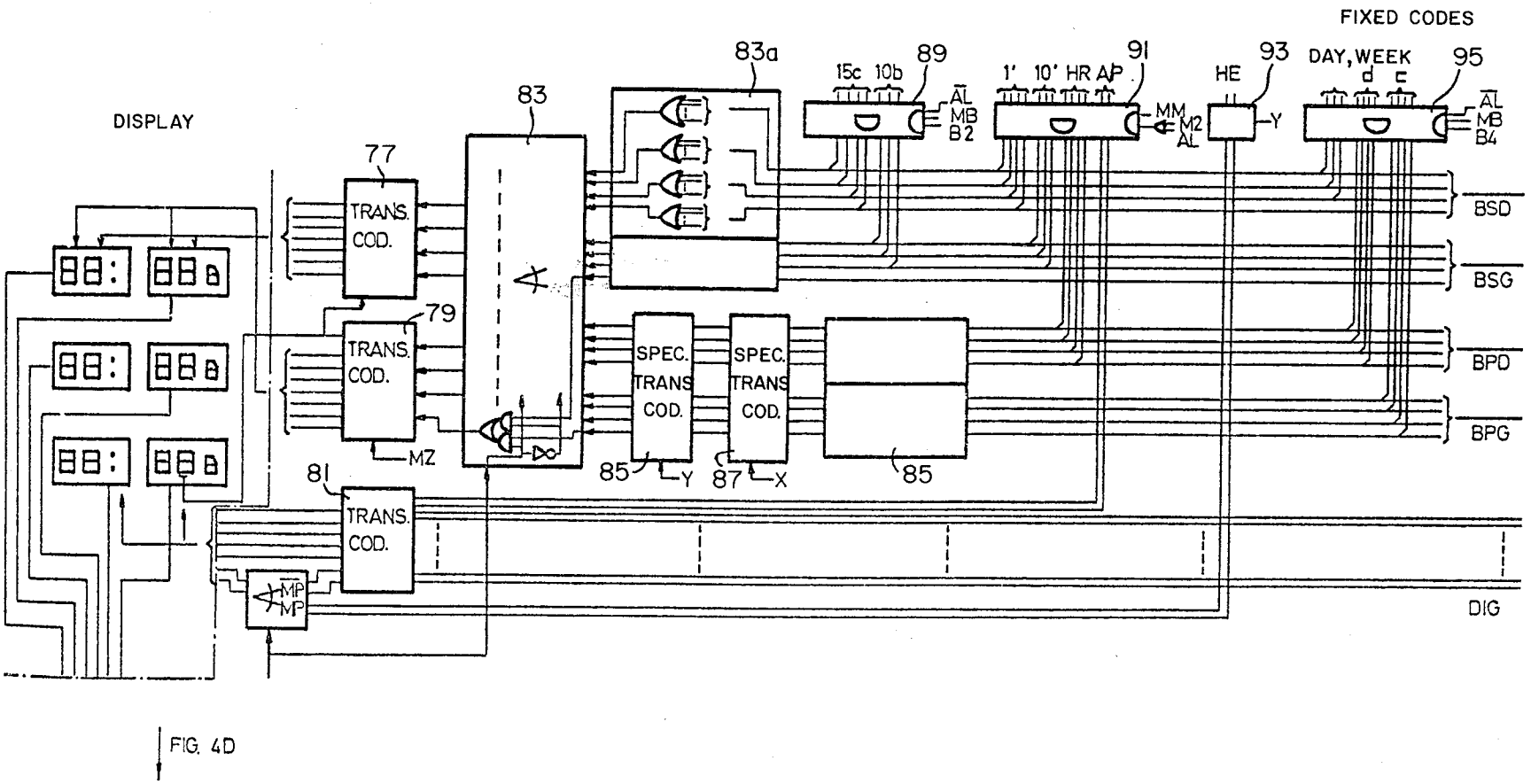
Figure 4B:
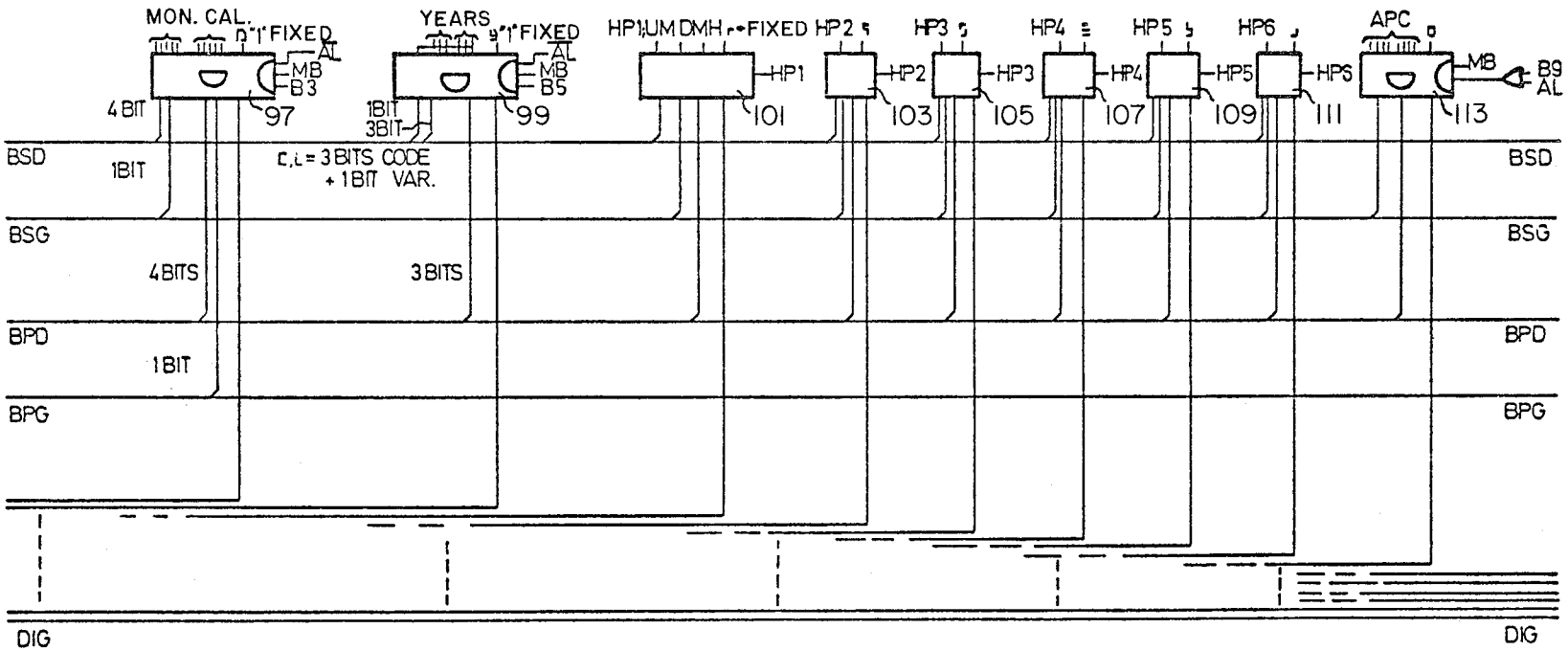
Figure 4C:
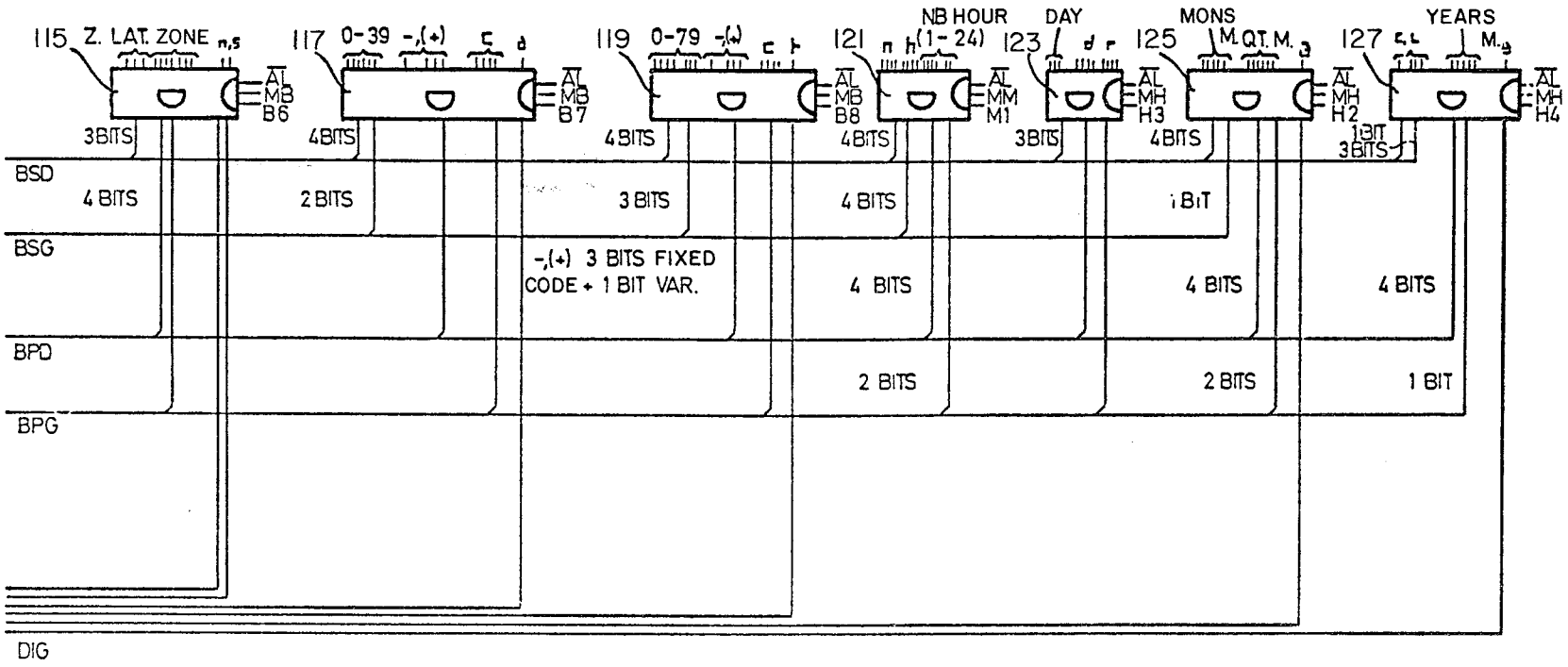
Figure 4D:
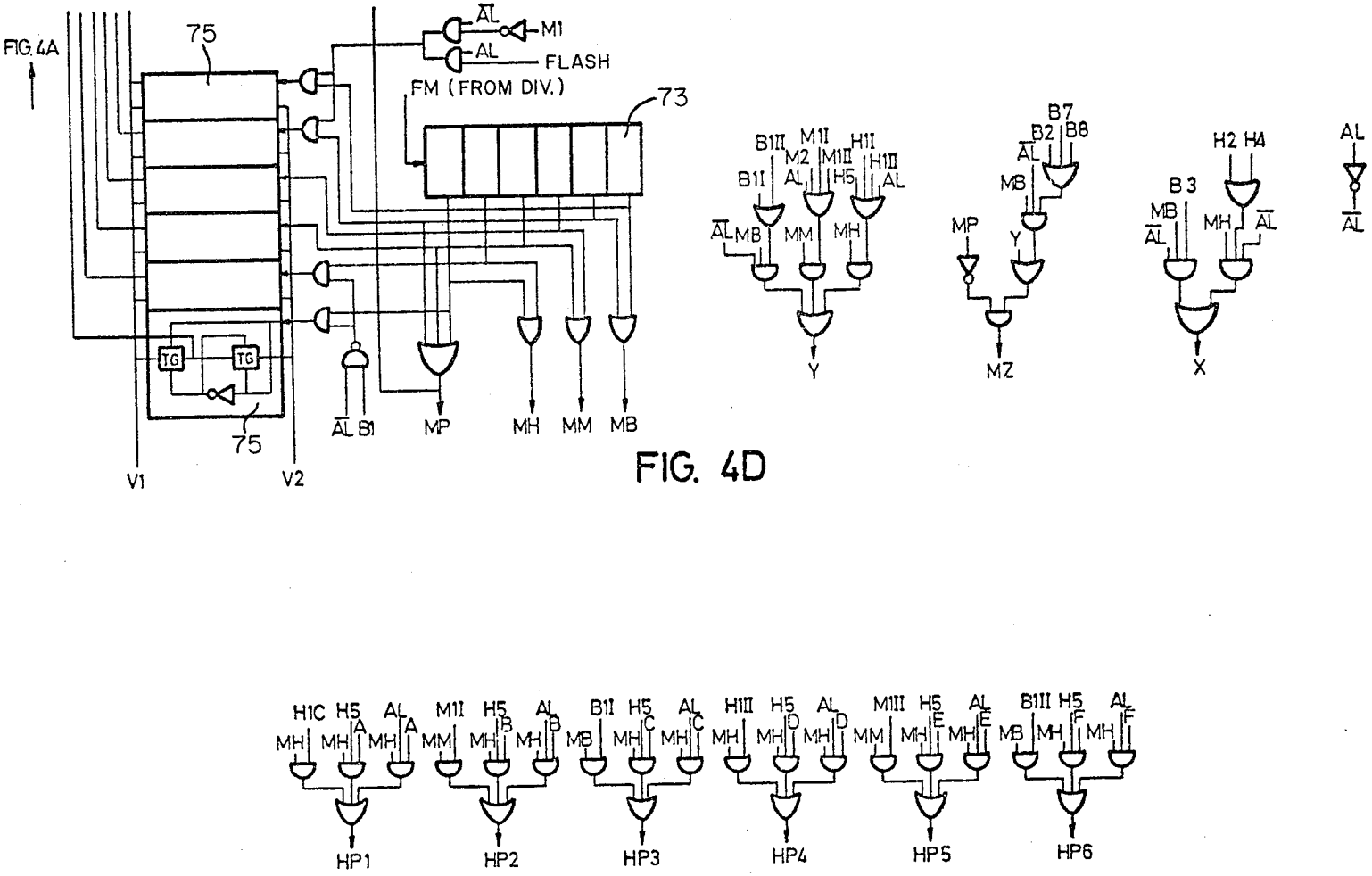
Figure 5:
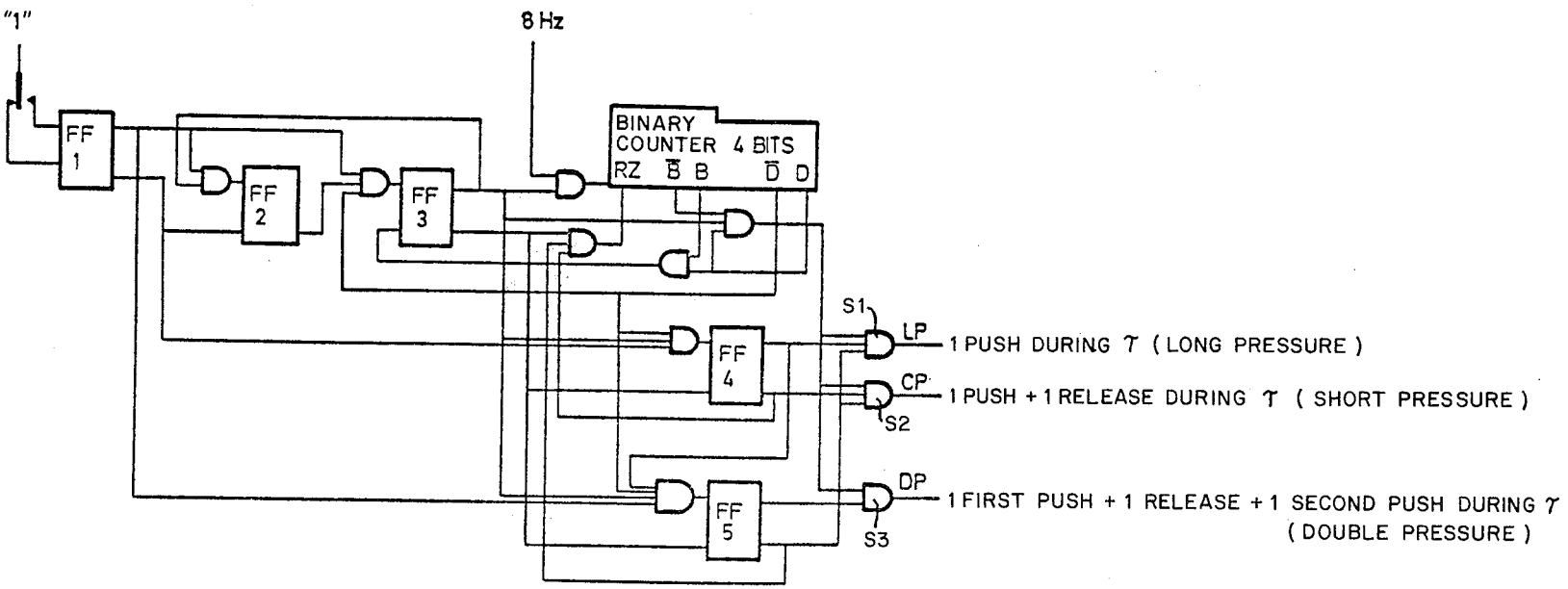
Figure 7A:
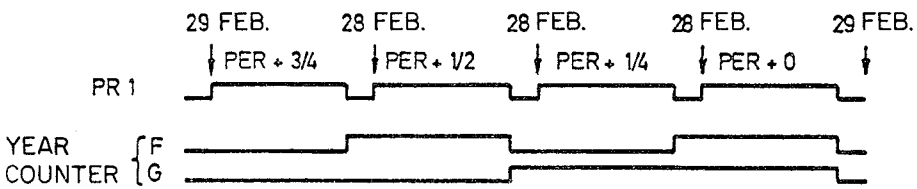
Figure 7B:
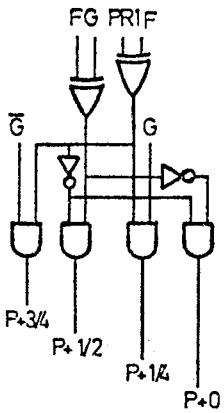
Figure 8:
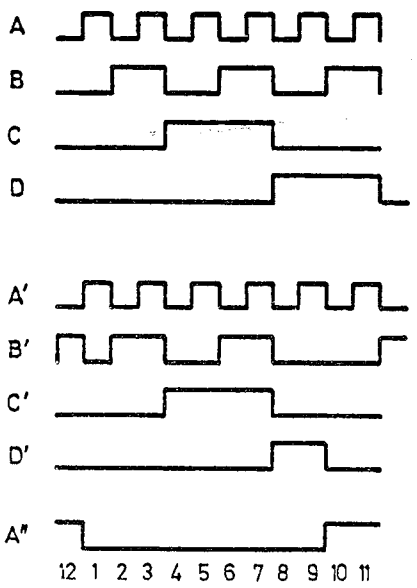
Figure 10:
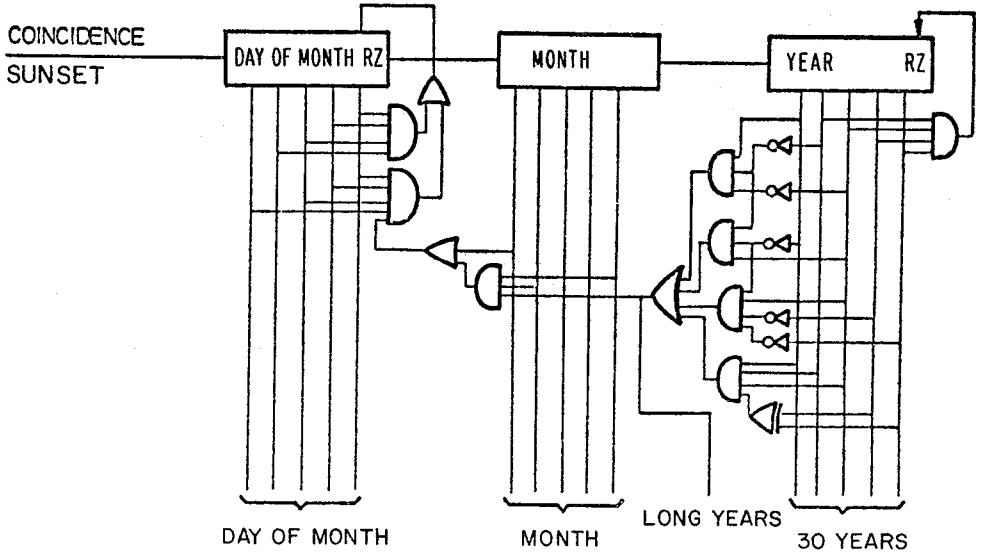
Figure 11:
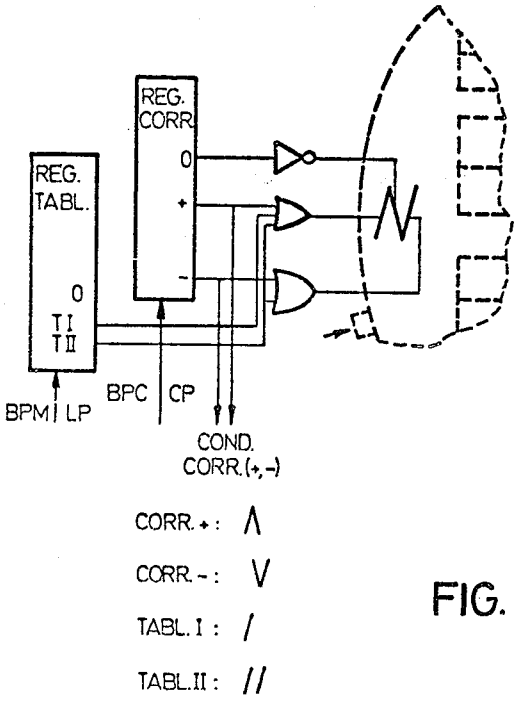

A preferred embodiment of the invention will now be described in detail with reference to the accompanying drawings, in which:

FIG. 1 is a front elevation of an electronic wrist watch of the type in question, comprising three lines of digital display, FIG. 2 is a table showing some of the combinations of display functions which may be presented on the three display lines of FIG. 1, there being shown in FIG. 2, successively from A to P, sixteen different combinations from amongst the approximately one hundred or so which are possible, FIG. 3 is a general block diagram of the electronic circuitry of the wrist watch in question, FIG. 4 (FIGS. 4A, 4B, 4C, and 4D) is a more detailed diagram of a display-control, multiplexing, and coding portion shown in FIG. 3, FIG. 5 is a detailed diagram showing the arrangement of the input circuits of the push-button switches of the watch in question, these circuits making it possible to obtain, without difficulty, three different control pulses with a single push button in order to limit the number of such buttons, FIG. 6 is a waveform diagram (A) together with a logical diagram (B) showing how, in the watch in question, counting of the months of the year is carried out in a manner facilitating both the display of the number of the month and the detection of certain particular states of the counter, e.g., the "February" position, FIG. 7 is a waveform diagram (A) together with a logical diagram (B) showing the manner of counting the years and of detectting the information for the periods "beginning of March—end of February," which periods must be known for computing of the parameters which are functions of the orbital position of the earth, FIG. 8 is a diagram, together with a table of logical equations, showing the constitution and function of a transcoder for the hour data as shown in FIG. 4 (4A), FIG. 9 is a waveform diagram (A) together with a logical diagram (B) showing the manner of counting up to about 30 steps for dates in the Gregorian calendar, dates in the Islamic calendar, and the 30-year cycle of Islamic years, FIG. 10 is a more detailed diagram of a circuit portion shown in FIG. 3 relating to the determination of Islamic calendar data, and FIG. 11 is a diagram, together with a partial plan view, showing the manner of controlling the supplementary display relating to possibilities of correction and to placing the watch in a special operating condition.

From FIG. 1, it will be seen that the wrist watch in question comprises a display face on which there are three lines of display, each of which includes four main display locations of one digit each plus two auxiliary locations for displaying one or two dots, on the one hand, and identification symbols, on the other hand. Four push buttons are disposed about the periphery of the watch, three of which, bpH, bpM, and bpB, are situated on the right-hand side of the watch case, as viewed in FIG. 1, each on a level with a display line, and the fourth of which, bpC, is situated on the left-hand side of the watch case, as viewed in FIG. 1, being used to establish the conditions under which possible corrections can be effected by means of the other three push buttons. There exist a great number of different possibilities of combining the displays of the three display lines, and besides the possibility shown in FIG. 1, sixteen other such possibilities are shown in FIG. 2.

With the aid of FIGS. 1 and 2, the completely external operation of the watch in question will first be described. The middle display line is basically reserved for displaying the time of day. For example, FIG. 1 indicates 10:28 a.m., as may also be seen in the first part (block A) of FIG. 2. The upper and lower lines may be (and most often will be) non-energized so that, as part A of FIG. 2 shows, the watch may display nothing but the official time of day. For the upper display line (H), there exists a series of types of data which may be caused to appear successively on this upper line by means of rapid pressures upon the push button bpH. For the upper display line, there is a cycle of five possibilities as follows:

- H1 resting (possibly tables, as will be explained in detail below),
- H2 Moslem calendar (day and month, changing at sunset),
- H3 day of the week (Moslem ritual day, which changes daily at sunset), H4 years (cycle of 30 Moslem years with short years and long years), and H5 next ritual hour (one of six ritual-hour data determined in a matrix and a calculator comprised in the wrist watch).

The display on the lower display line B comprises a more extensive range encompassing nine possibilities. These are:

B1 resting (with a possibility of display in tables, similarly to H1),

B2 display of the seconds, recognizable from the fact that it changes each second, without any identification symbol being necessary, B3 calendar date (date and month of the Gregorian year), B4 day of the calendar week (identical with the Moslem day of the week except for changing at midnight instead of at sunset), B5 type of Gregorian year, i.e., 1st, 2nd, or 3rd year (short or common years), or 4th year (long or leap-year), B6 geographical zone (time zones for the longitudes and zone of 10° latitude with indication of "south" or "north" (s, n) in the auxiliary identification field), B7 local correction of latitudes in distance-units of 25 km each, maximum ±39 units or ±975 km, B8 local correction of longitude effected directly in minutes, the lag (between true noon at the point in question and true noon at the center of the time zone) becoming greater as one proceeds west, and B9 "orientation towards Mecca" given by one of the eight indications S, SE, E, NE, N, NW, W, SW.

Starting from B1 or H1, the information advances by one step in the above-mentioned cycles each time a brief pressure is exerted on the corresponding push button (bpH for the upper line and bpB for the lower line). Moreover, a prolonged pressure causes the display to pass automatically to the last item of the cycle (H5, next ritual hour; B9, orientation towards Mecca); and if the button is pressed twice in rapid succession, the cycle returns to the first position (H1, B1, resting). In any case, a long pressure followed by a short one has the same effect since this leads initially to the last position, and thence back to the first position by an advance of one step.

The middle display line has only two positions which are reversed each time a brief pressure is exerted upon the middle push button bpM. The first position, M1, causes the hour of the Moslem day to appear, i.e., the FIG. 1 is displayed during the first hour after sunset, the FIG. 2 during the second hour after sunset, etc., this being approximate and continuing up to 24. As will be seen below, the tables data may also appear in this first position.

The second and last position of the middle display line, i.e., the position M2, causes the official time of day (standard time) to be displayed, which is the most common function of the wrist watch.

The "tables" function, or more properly the "tables" operating condition, is switched on by means of a prolonged pressure on the middle push button bpM. As soon as the tables operating condition is switched on, the three cycles of the upper, middle, and lower display lines automatically pass into their first positions, but then they need not necessarily remain there, for brief pressures upon the corresponding push buttons can cause the cycles to advance despite the tables operating condition. At the same time, the tables operating condition, which is divided into a first table condition TI and a second table condition TII, causes the appearance in the first position of each of the three cycles of the first three or last three ritual hour data determined in the calculating part of the electronic watch. At H1 and B1, these data occupy an empty place, whereas at M1 they replace the indication of the hour of the Moslem day. Thus, when the tables condition is switched on, the first indications to appear are the first three ritual hours, viz., from top to bottom, "90 minutes before sunrise" on the upper line, "sunrise" on the middle line, and "time when the sun passes the meridian" on the lower line. These are the data H1TI, M1TI, and B1TI, respectively. Another prolonged pressure upon the middle push button causes the second half of the tables condition to appear, i.e., the indication of the "sinking sun" time on the upper display line, the indication of the "sunset" time on the middle display line, and the indication of "app. 90 minutes after sunset" on the lower display line. These six indications are each identified by a symbol in the auxiliary display position; each such symbol forms part of an incomplete S, the appropriate segments thereof appearing consecutively from top to bottom for the indications 1 to 6. Starting from the tables operating condition, the cycles may be caused to advance as desired by means of the normal manipulations for controlling the advance or the jump within a cycle; however, as long as the tables condition is operative, the first positions of the H cycle and B cycle will be occupied by ritual hour data rather than resting. By the same token, the middle display line will have either the official time of day (standard time) or a ritual hour indication, rather than either standard time or the hour of the Moslem day. Each time the next ritual hour indication is displayed, its identification symbol flashes, thereby indicating that precisely this hour is the next ritual hour.

Whenever the ritual hour data (even if not displayed just then) and the standard time data coincide, the watch goes into an alarm condition, i.e., it compels the last position of the cycle to appear in the upper and lower lines, signifying that right at that moment it is the ritual hour to be observed (with its identification symbol), the indication of the direction towards Mecca also being shown. Thus the adherent of Islam will immediately be able to perform the rites which the Koran prescribes for him at that time. It will be noted that when the alarm appears, the table condition is automatically suppressed if it was still proceeding then.

It remains to be explained how the displayed indications can be corrected. It should be noted at the outset that it is not possible to correct the data calculated by the watch if they are based on false premises, i.e., if the watch is not adjusted to the correct day, or to the correct time zone, or to the correct latitude, etc., and therefore the sunset hour (for example) is wrong, the sunset hour cannot be directly corrected and it is the adjustment (day, latitude, etc.) which must be corrected.

As stated above, a fourth push button bpC is situated at the left-hand side of the watch, as viewed in FIG. 1. This push button is used to switch on the correction operation condition, either forward or backward, and actuates a cycle of three positions: a zero position, a position for forward correction, and a position for backward correction. For instance, when forward correction is selected (indicated by a small arrow pointing upward which appears at the extreme left of the watch near the button bpC), manipulation of the three line buttons produces quite a different effect. In this situation, a brief pressure on the push button causes a one-step advance—or a one-step back-up if backward correction has been selected—of the first figure on the right, e.g., the units of minutes, of the corresponding line. The result of a longer pressure is an advance (or back-up) of the second figure from the right of the line in question (e.g., the tens of minutes), and finally, a double pressure (push button pressed twice in very rapid succession) causes an advance (or back-up) of the number appearing towards the left of the line, e.g., the units of hours in this instance. If it desired to correct the tens of hours, ten corrections of hour units must be made.

The correction functions are automatically adapted to the display functions, i.e., only a displayed indication can be corrected, and it is corrected as a function of the location where it appears on the face of the watch. The same pilot wires which control the appearance of the various indications on the display lines control the possibilities of correction of the counters or registers which supply these indications. As will be seen below, most of these counters or registers operate bidirectionally As concerns the display of the "tables operating condition" or "correction operating condition," the watch bears at the lower left, as viewed in FIG. 1, a small symbol in the form of an N. Depending upon which of the two sides of the N is removed, the symbol represents an arrow pointing upward or an arrow pointing downward, corresponding respectively to a forward or backward correction possibility. Moreover, in the "tables operating condition" (which is never switched on simultaneously with the correction operating condition), the first table (or first table portion) TI causes one of the uprights of the "N" to be energized, while the second table (or second table portion) TII causes both uprights of the N to appear, thus yielding the display I or II, respectively.

As concerns FIG. 2, it will be noted that the geographical zones "23rd time zone, 2nd zone north latitude" (F) and "3rd time zone, 2nd zone south latitude" (G) actually correspond to inhabited regions, Senegal (Dakar) being in the first of these zones, and the second comprising the whole northern part of Madagascar (Tananarive). As for the location of "time zone 16, 4th zone north," shown in the lower zone in FIG. 1, it corresponds to San Francisco.

Finally, a factor which cannot be neglected is the so-called "summer-time" (daylight-saving time), sometimes even "double summer-time," and also, but very rarely, "slow time." All data concerning a time of day given by the watch are normally accompanied by a dot appearing between and on the same line of writing as the hours and the minutes. If this dot is on the same line, the time is the normal one for that time zone. If the dot appears above the line of writing, the time is summer- or daylight-saving time; and if a colon appears instead of a single dot, it is double summer-time. By the same token, if no dot appears, it signifies "slow time."

To make a correction corresponding to summer- or daylight-saving time, the watch will be set ahead one hour, just as with a mechanical watch, and automatically a "summer-time" register will accept a change-over to summer-time. The same applies to double summer-time (two hours ahead) or slow time (one hour behind). If on the other hand, it is desired to set the watch ahead one hour for the purpose of actually correcting the setting rather than going on summer- or daylight-saving time, the procedure is to jump three hours ahead, then two backward. The first two jumps forward will put the "summer-time" register in the "double summer-time" position, the third jump ahead will not change that in any way, and the two jumps backward will return the "summer-time" register to its normal position, even though the watch will be set ahead by one hour. To set the watch back, the procedure will be reversed.

For corrections according to changing over the time zone, not the "hour display" but the "time zone display" has to be corrected. "Hour display" correction will automatically follow.

FIG. 3 is a general diagram of the electronic watch in question; it comprises legends enabling it to be understood easily. The counting of standard time, from the oscillator and the frequency-divider 11 to the counting of the years, is relatively conventional and requires no particular explanation. In accordance with the months and the years, the number of counts of the days in the month is brought to 28, 29, 30, or 31. This is done by means of a reset circuit 13 which, at the same time, supplies information for marking of the four successive periods recurring from each first of March to the end of February of the following year. This plays a relatively important part in determining the ritual hours, which are connected with sunrise and sunset, and for which it is necessary to take into account as exactly as possible both the position of the earth in its translatory motion about the sun and also the latitude. A calculator portion 15 determines the ritual hours starting from two parameters which are, firstly, the angle $\alpha$ between the axis of the earth and a straight line joining the centers of the earth and the sun, and secondly, the difference $\delta$ between true noon (fluctuating) and integrated noon (consistent). In the middle of a time zone where normal time obtains, e.g., at Greenwich, integrated noon corresponds to standard noon. A matrix stores 96 data, or eight per month, which always fall automatically on the first, the fifth, the ninth, the thirteenth, the seventeenth, the twenty-first, the twenty-fifth, and the twenty-ninth of the month (reference date). For the intervening days, the matrix gives a quantum by means of which the calculator obtains the parameter values by addition of a certain number of quanta. A quantum corresponds to a segment of three hours ($\frac{1}{8}$ of a day) of the earth's revolution around the sun. Thus, since the parameters are desired for the moment when the sun passes the meridian at the geographic point in question, any displacement of at least three time zones will cause the addition or subtraction of a quantum and, furthermore, one day more will result in the addition of eight quanta. Moreover, the exact values of the parameters are established for a period running from the first of March of a non-leap-year preceding a leap-year to the twenty-ninth of February of this leap-year. During this period, the values of parameters determined as indicated above are exact. After 29 February, at any given hour of any given day, the earth will always be situated eighteen hours, i.e., six quanta, farther on its orbit than on the same day and at the same hour of the preceding year. Therefore, six more quanta should be added during this first period, and the calculator will do this. Then, during the following period, a quarter of a day has been lost, and no more than four quanta will have to be added. During the following period, it will be but two quanta, and finally, for the period coming just before a twenty-ninth of February, there will be no quanta at all to add. Although the calculator has not been drawn in detail, its mode of operation will be easily comprehended; the data leading to the sides of the block 15 (representing the calculator in FIG. 3) are presented from top to bottom in the order in which they are taken into consideration by the calculator. Thus, it first considers the date and must, for that purpose, recognize the reference date (e.g., if the date is 15 April, it will recognize the fourth reference date in April, which is 13 April), then the number of days beyond the reference date (e.g., two days—after 13 April—if it is then 15 April). The reference-date information, valid for a period of four days, is supplied by the third, fourth, fifth bits of the date-counter of diagram block 19 and by the bits of the month-counter of diagram block 19. The first and second bits (of lesser weighting) of the date-counter will give the number of days beyond the reference date and will cause the addition of eight quanta, of sixteen quanta, and of eight + sixteen quanta for one, two, or three days of difference, respectively. Next will come the corrections by six, four, and two quanta to take into account whichever "beginning March-end February" period it is. Then come corrections by quantum which will be made from the time-zone register 23, with three time zones having the value of one quantum (if so desired, the calculator can be arranged to take into account also at this point the local correction of longitude--up to ±79 minutes, 1 arc degree for four minutes-since this local correction may be equivalent to an advance or regression of a time zone). Finally, provision is also made to effect a "Gregorian correction," if necessary, to take into account that a year does not last exactly 365¼ days. This "Gregorian correction" is simply carried out by hand, e.g., at the watchmaker's, in that a "Gregorian correction register" 23 is caused to advance by one step by briefly grounding a point which may be discovered with the aid of a tool when the watch has been opened (possibly when the battery is being changed). This "Gregorian correction" requires approximately a correction of one quantum every twelve or thirteen years. The above-mentioned procedure will enable the calculator first to calculate the difference between true noon and integrated noon, then, taking into account the local correction of longitude (deviation in minutes from the center of the time zone), and, if need be, the fact that instead of the normal time there is summer- or daylight-saving time (or possibly double summer-time or slow time), to calculate the exact hour and minute when the sun passes the meridian at the location in question, expressed in the standard time system, given by the watch and for all the other watches in that place.

Furthermore, the calculator will calculate the hours of sunrise and sunset. For that purpose, it will consider, firstly, the angle $\alpha$ between the axis of the earth and the earth-to-sun line, and secondly, the latitude $\lambda$ which will be given by the "geographic" register (diagram block 21) as well as by the local-latitude-correction register 25.

If it is assumed that the parameter consisting of the angle $\alpha$ does not vary during a single day, the interval between the rising of the sun and its passing the meridian equals the interval between its passing the meridian and sunset. The calculator calculates this interval as a function of the angle $\alpha$ and of the angle $\lambda$representing the latitude. In the watch, the angle $\lambda$ is entered in the register of zones of latitude (diagram block 21), on the one hand, each such zone extending over ten degrees of latitude, and in the register 25 of local corrections, on the other hand; with respect to the middle of a zone, the latter establish positive or negative corrections in units having a value of 25 km, i.e., 0.225 degrees, or 9/40 of a degree. In order to establish the value of the parameter $\alpha$ entering into consideration, the calculator proceeds similarly to what has been described concerning the parameter $\delta t$, i.e., it takes from the matrix 17 a $\delta t$ value corresponding to a reference date, then it adds a certain number of quanta (the value of a quantum is supplied by the matrix 17 together with the value of the parameter) in order to obtain the value of the parameter $\alpha$ just at the moment and at the location in question. In order to obtain the parameter $\alpha$ at the moment when the sun passes the meridian, exactly the same number of quanta would be added as were added to obtain the value of the parameter $\delta t$. However, since sunrise takes place, on an average, about six hours before the sun passes the meridian, and since sunset takes place, on an average, about six hours after the sun passes the meridian, the calculator is arranged to take two quanta less for the value of the parameter $\alpha$ at sunrise and to take two quanta more for the value of the parameter $\alpha$ at sunset.

With the two data concerning the latitude (angle $\lambda$) and the parameter consisting of the angle between the axis of the earth and the earth-to-sun line (angle $\alpha$), the calculator is able to calculate the interval between sunrise and the moment when the sun passes the meridian, and the interval between the latter moment and sunset. In order to do so, it applies the following formula:

$$t_i = (12 \text{ hr. } 00 \text{ min.}) 1/\pi \cos^{-1} (\tan \lambda \operatorname{ctn} \alpha$$

During the course of the year, the angle $\alpha$ varies within limits indicated by the following equation:

$$113°26' > \alpha > 66°34'$$

For the values of $\alpha$ greater than 90°, $t_i$ is greater than 6 hr. 00 min. because the cosine is negative, whereas for the values of $\alpha$ less than 90°, $t_i$ is less than 6 hr. 00 min. because the cosine is positive. This means that for the northern hemisphere, the angle $\alpha$ is to be considered the angle formed by the earth-to-sun line with the southern portion of the earth's axis, and vice versa. As a function of the days of the year, the matrix stores the values of the parameter $\alpha$ for the northern hemisphere, i.e., the values of the parameter $\alpha$ corresponding to the angle formed at the center of the earth by the sun-to-earth line and the portion of the earth's axis pointing towards the south pole. For the southern hemisphere, the calculator will take the supplement of the angle $\alpha$ $(180° - \alpha)$ or else will invert the results with respect to 6 hr. (e.g., 7 hr. 13 min. instead of 4 hr. 47 min.). After having determined the intervals $t_i$ for sunrise and sunset, the calculator will check that these intervals are neither less than 4 hr. 30 min. nor greater than 7 hr. 30 min. If that should happen, the calculator would do the calculation over again, taking only one quantum less for sunrise and only one quantum more for sunset if the interval is less than 4 hr. 30 min., and taking three quanta less for sunrise and three quanta more for sunset if the interval is greater than 7 hr. 30 min. Furthermore, if the interval is less than 3 hr. or more than 9 hr., the calculator leaves it at those values and stores this fact.

Once the calculator has calculated the interval, it subtracts the interval relative to sunrise from the standard time at which the sun passes the meridian, thus giving the time of sunrise expressed in terms of standard time; and it adds the interval relative to sunset to the standard time at which the sun passes the meridian, thus giving the time of sunset expressed in terms of standard time. In this way, the calculator determines the second and fifth ritual hours, the third being the time when the sun passes the meridian. To obtain the first ritual hour, the calculator simply subtracts one hour and thirty minutes from the second ritual hour (sunrise); and to obtain the sixth ritual hour, the calculator simply adds one hour and thirty minutes to the fifth ritual hour (sunset).

Theoretically, the fourth ritual hour is that at which the shadow of an obelisk is twice as long as the obelisk itself, meaning that the elevation of the sun must then be 26°30'. The calculator calculates the interval between the sun's passing the meridian and its 26°30' elevation by means of the following formula:

$$t_i = (12 \text{ hr. } 00 \text{ min.}) 1/\pi \cos^{-1} (\tan \lambda \operatorname{ctn} \alpha + (\sin 26°30'/\cos \lambda \sin \alpha)$$

As soon as the geographical point being considered is situated at a relatively high latitude and the date is close to the solstice of the shortest day in the hemisphere being considered, this formula no longer gives any result for the good reason that the sun does not reach 26°30' even at its maximum point, for the maximum height of the sun equals $\alpha-\lambda$, or for the southern hemisphere, $180°-\alpha-\lambda$. Thus it will be seen that at the winter solstice, the maximum height of the sun is about 26°30' approximately at the location of the 40th parallel. As concerns the interval $t_i$, for the fourth ritual hour, the calculator fixes the minimum at 2 hours and the maximum at 7 hr. 30 min.

It has just been seen how the electronic circuitry of the watch establishes the six indications of the Moslem ritual hours. As concerns the "direction towards Mecca," the matrix 17 stores directly the data for 368 of the 384 co-ordinate zones corresponding to the combinations of 24 time zones and 16 zones of latitude (eight for each hemisphere). For the 16 co-ordinate zones surrounding Mecca, extending over the four time zones 1, 2, 3, and 4 and over the four northern hemisphere zones 1, 2, 3 and 4 (each counting 10° of latitude), the matrix supplies information in terms of a division of the co-ordinate zones into three in each direction, i.e., a division into nine. This increases the number of points for which a direction is stored to 128, in addition to the 384 which would exist without this finer division. However, in the 16 restricted fields surrounding Mecca (each of which has a surface area equal to one-ninth of a large co-ordinate zone), a further subdivision takes place which increases the number of locations for which a direction is stored by another 240. Finally, in the immediate vicinity of Mecca, an even finer division further increases the number of locations to be stored by another 48. Therefore, it is for a total of 800 different locations on the earth that the matrix stores one of the eight data N, NE, E, SE, S, SW, W, and NW. In the matrix, these zones are addressed by the data from the geographical register 21 of the large co-ordinate zones, and from the registers 25, 27 of local latitude correction (in distance units of 25 km, i.e., of 9/40 of an arc degree) and longitude correction (in minutes, i.e., in quarters of an arc degree). At its "direction-of-Mecca" data output 29, the matrix directly encodes in the desired manner the binary data for the second and third display locations (and indirectly for a part of the fourth one), these coded data, B9, being intended for display on the third display line of the watch. It will be noted that for an approximately square zone of about 25 km on each side in which the city of Mecca itself is situated, the matrix does not supply any data except for the indicator symbol "orientation" in the auxiliary field.

It has just been seen how a number of quite unusual data, pertaining to the Moslem ritual, are determined in the watch in question. The data concerning geographical co-ordinate zones, from the latitude and longitude register 21, are likewise available for display and, as the case may be, for desired positioning, at B6. Moreover, the data concerning local corrections for the latitudes (in distance units of 25 km) and for the longitudes (in minutes of time) are also available for display and, if need be, for correction, at B7 and B3, respectively.

It should also be noted that the calculator 15, which receives high-frequency pulses Via line 31 from the frequency-divider 11 for its operation, automatically carries out a new determination of the six ritual hours each time at least one of the data supplied at its various inputs undergoes a change.

These six ritual-hour data are supplied to a coincidence detection stage 33 which also receives the current time information in minutes and hours, including the information AM/PM. This coincidence stage operates continuously under the effect of a clock frequency which it receives from the frequency-divider, and at six outputs corresponding to each of the ritual hours it supplies logical information indicating either that this ritual hour has already passed during the course of that day (level "0"), or that this ritual hour is still to come or is just then present (level "1"). These six logical data are sent to a "recognition and selection of the next or present ritual hour" stage 35, which applies a "1" level only on one of its six output conductors which corresponds to the next ritual hour or to the ritual hour corresponding to just the present moment. These output conductors are connected to a symbol-flashing control stage 37 which applies cadenced flashing interruptions to one of six conductors which control the illumination of the identification symbols when the corresponding ritual hour is displayed. These six identification symbols need not be coded at this location because they are each sent directly to a different input of a general coder when a gate circuit selects the corresponding information.

The coincidence detection stage also supplies a signal, over a single conductor, at the very moment when a coincidence is detected with any one of the six ritual hour data. At that moment, an alarm circuit 39 receiving minute pulses starts operating for a period of five minutes, during which it blocks the "recognition and selection of the next or present ritual hour" stage 35 so that this stage remains in the state it then occupies as long as the alarm circuit 39 is operative, even though one minute later the ritual hour in question will be considered to be past within the coincidence detection circuit. An alarm-cancelling order may, however, be given before these five minutes are up by means of a long pressure on the correction-cycle control push button (which controls that cycle only when that push button is pressed briefly).

The output of the alarm circuit 39 is connected to the display-control, multiplexing, and coding circuit 41 and simultaneously to the symbol-flashing control circuit 37, by which route it stops the flashing of the symbols. When the alarm is given to the display-control, multiplexing, and coding circuit 41, the latter, which also receives the six outputs of the recognition and selection of the next or present ritual hour circuit 35, selects, as a function of that one of those outputs which presents a "1" level, the ritual information indicated as being next or present, but which is actually present since the alarm is operating. This display-control stage 41, upon receiving the alarm, thus causes the obligatory display of this present ritual hour on the upper display line. At the same time, by acting upon the multiplexing scanning circuit, it causes the flashing of all the indications given on this upper display line, so that all the information concerning the present ritual hour flashes. Still at the same time, under the control of the alarm, the display-control, multiplexing, and coding circuit 41 necessarily causes the information on the direction of Mecca to appear on the lower display line, so that the wearer of the watch has right on his wrist, first, the indication of the standard time of day; second, the indication of the fact that a Moslem ritual hour, identified by its identification symbol in the auxiliary display location, is present at that very moment; and third, the indication of the direction of Mecca towards which he must face for his ritual prayers.

As soon as the "cancellation of alarm" order has been given manually, the alarm circuit is reset, even if the five minutes of timing are not yet up, and the watch resumes operation as before. If the alarm cancellation is not actuated manually during those five minutes, the alarm circuit is reset at the end of that period so as not to keep the watch needlessly in alarm condition any longer.

To explain the operation of the alarm simply, it may be said that it automatically causes each of the three display cycles (upper, middle, and lower lines) to pass to its last position, as would be done by a prolonged pressure on each of the two push buttons bpH and bpB, while the standard time would assuredly be displayed on the middle line.

It may be seen from FIG. 3 how the cycle for counting Moslem time operates. For that purpose, the coincidence detection circuit 33 additionally supplies a pulse when it detects a coincidence with the fifth ritual hour (sunset). At that moment, it resets a modulo 6 counter 43 which counts the tens of minutes of the standard time of day. Thus, after a period which may last between 51 and 60 minutes according to the moment when sunset took place, a pulse leaves this modulo 6 counter and causes the operation of a 0–9 counter 45 which had been returned to the "1" position at the moment of the sunset pulse. Thus, for approximately one hour, the watch will indicate that the first Moslem hour is then in progress if the position M1 of the cycle of the middle display line is chosen. After an hour, which will correspond to a whole number of tens of minutes of standard time, this indication will become that of the second Moslem hour, then an hour later that of the third Moslem hour, i.e., the third hour after sunset. This 0–9 counter furnishes a carryover to a 0–2 counter 47 which is likewise reset at the moment of sunset, so that this counting and this display of the Moslem time can continue until sunset on the following day, i.e., for twenty-four hours. The 0–9 and 0–2 counting as a whole is preferably arranged so that it cannot go further than 24, which otherwise might happen, especially because at the vernal equinox, chiefly in the northern regions, up to 24 hours and three or four minutes may pass.

The information concerning the Moslem hour is applied at M1 to the display-control, multiplexing, and coding circuit 41.

In order to make the operation of the watch correspond to the decisions of certain Moslem governments, the sunset pulse could, if need be, be replaced by a pulse occurring regularly at 6 p.m. every day, or, to prevent any indefiniteness, by a pulse occurring at 20 seconds past 6 p.m., for instance. The sunset pulse (or possibly, as a replacement, a 6 p.m. pulse) is also applied to a set of bidirectional counters 49 which count the Moslem days of the month (almost always alternating between 29 and 30 days), the Moslem months (always 12 in number), and the Moslem years within the 30-year cycle during which common (or short) years and intercalary (or long) years follow one another in a very special order of succession. In the course of this 30-year cycle, the 2nd, 5th, 7th, 10th, 13th, 16th, 18th, 21st, 24th, 26th, and 29th years are long or intercalary years, during which the twelfth month has 30 days instead of 29. In order to distinguish between those cases where the months must have 29 days and cases where the months must have 30 days, a reset circuit 51 is controlled by the Moslem month- and year-counters and acts upon the Moslem date-counter 49.

Besides that, a 1–7 counter 53 counts the days of the Moslem week, starting each time from the sunset pulse.

From FIG. 3, it will be seen that the correction, display-cycle, and alarm-cancellation control circuit 55, 57 (which is shown divided up for ease of illustration), if suitably conditioned, sends correction pulses to the various bidirectional counters as well as to the geographical position registers. It will be noted that the longitude register 21, which counts the time zones, likewise sends a pulse to the correction control circuit 59 to bring about a corresponding correction of the hours and, in addition, when there is a passage from the 13th to the 12th or from the 12th to the 13th time zone (as identified by block 61), a corresponding correction of the dates and days of the week which must then change. In order that this may not at the same time cause an improper variation of the computation of the parameters $\alpha$ and $\delta t$, the correction of the quanta due to the time zone is such that eight more quanta are added for time zone 13 than for time zone 12. The starting situation is re-established little by little for a person who travels around the world and adapts the longitude register of his watch as he successively crosses the boundaries of the time zones.

Part of the correction control circuit, diagram block 63, (certain special features of which will be explained in more detail in connection with FIG. 5) controls, through the action of the push buttons, the advance of the registers 65, 67, 69 of the H, M, and B display cycles. This same circuit also controls the tables register 71, having three positions, "0", "T1", and TII. The output of this tables register also divides the first outputs of the three registers H, M, and B into three different outputs each. All the outputs of these registers are applied, over a single conductor, to the display-control, multiplexing, and coding circuit 41 so that the latter may suitably select the various data supplied to it in order to cause them to appear on the proper display lines.

FIG. 4, composed of FIGS. 4A, 4B, 4C and 4D shows the mode of operation of the display-control, multiplexing, and coding circuit seen in FIG. 3. Generally speaking, a shift-register 73 receives a multiplexing frequency FM from the divider 11 and causes a "1"

level to pass successively over six conductors of different outputs. These output conductors control gate circuits 75, containing transmission gates, which cause a potential V1 to pass successively over the left half of the upper display line, then over the right half of that line, than over the left half of the middle display line, then over the right-hand part of the latter, then over the left-hand part of the lower display line, then over the right-hand part of the latter, and so on. Thus the potential V1 is led over the common electrode of each of these parts, this potential being such that a high-level potential on the electrodes of segments facing the common electrode causes these segments to be energized, During this time, the other five of these six parts receive a potential V2 (which may, for example, be a medium potential or a high-frequency variable potential) such that neither a high level nor a low level on the electrodes of segments facing the common electrode can cause the corresponding segment to be energized. Under these conditions, multiplexing is easily carried out, whether it be with a liquid-crystal display device, preferred for the watch in question, or possibly with another type of display device, e.g., light-emitting diodes. The segments of the different display locations are driven by transcoding and display-control stages 77, 79 and 81. These transcoders do not encode solely as a function of BCD data they receive at their inputs, but as a function of binary data, with sixteen positions, which makes it possible to display characters other than numerals. The two transcoders 77 and 79 are identical only in the way in which they transcode the ten BCD data; they differ, on the other hand, in the way in which they transcode the other six binary combinations possible with four bits, and this makes it possible to have a large number of symbols other than numerals, the same binary composition giving two different characters depending upon whether it is intended for a first display location of one of the six multiplexing zones (first and third display locations of each line, controlled by the transcoder 79) or for the second display location of each multiplexing zone (second and fourth display locations of each line, controlled by the transcoder 77). As for the transcoder 81, it furnishes a seven-segment display for the identification display location plus a two-dot display for indicating summer-time, etc. The transcoder 81 does not receive BCD information at its input but rather digital information over a number of conductors equal to the number of orders it is to receive. However, the "left zone/right zone" multiplexing of each line is not carried out, for the third decoder, at the input thereof, but only over two output conductors of the transcoder 81 since the other information to be multiplexed comprises only two conductors, intended for the two dots. As for the multiplexing among the three display lines--upper, middle, and lower—it is carried out directly on the gates which select the various data likewise as a function of the display-cycle registers.

The two transcoders 77 and 79 are multiplexed at their inputs, by a multiplexing stage 83, controlled "modulo two" by the multiplexing timing register 73.

The inputs of the multiplexing circuit 83 therefore consist of four series of BCD inputs, each of which controls one of the display locations of each line. These inputs are assumed to contain OR gates having a large number of inputs, as symbolized at reference numeral 83*a* in FIG. 4A, where it may be seen that a single line shown as entering the circuit 83*a* actually includes a plurality of conductor grouped at the inputs of an OR gate.

The two groups of BCD inputs supplying the first zones of the lines are provided with two special transcoders 85 and 87 which are put in operation only on command by signals y and x, these special transcoders being intended to convert the non-BCD four-bit data 12 or five-bit data 32, coming from the hour-counters, as well as from the date- and year-counters in the 30-year Moslem cycle, since, for the remainder of the circuit, it is advantageous for these counters to operate according to a simple four- or five-bit system, whereas for the display, it is necessary to split them into two pairs of BCD-type data, for the tens and the units, respectively.

The upper part of FIG. 4 shows a whole series of gates which control the input to the display of the various data which are applied to the display-control, multiplexing, and coding circuit, as shown in FIG. 3. These gates 89 to 127 effect the input of the various data only upon the fulfillment of conditions which are represented by data combined in at least one AND gate situated at the input of each of the gate circuits 89–127. When all the control conductors are at level "1", the various conductors which supply the data can "cross" the gate circuit, which contains as many data-input control gates as there are conductors to control. In fact, this number might reach sixteen per gate circuit, but there are generally fewer because each item of information leaves certain bits unoccupied. It will be seen that the gate circuits also open the way for a "1" level controlling one of the 19 inputs of the transcoder 81 to cause the appearance of one of 16 identification symbols for the various data (see FIG. 2). Otherwise, the diagram in FIG. 4 is explicit enough in itself, taking into account what is also shown in FIG. 3, so that there is no need of going into its particularities any further here (these being particularities which those skilled in the art will comprehend simply by looking at the diagram).

FIG. 5 shows how it is possible to derive three different pulses, which do not interfere with one another, from a single push-button switch, which performance is effected in the display-cycle correction and alarm-cancellation control circuit shown in FIG. 3.

The diagram in FIG. 5 shows a flip-flop FF1 which merely repeats, but eliminating the rebounds, the changes of state of a change-over switch. A flip-flop FF3 changes state when the flip-flop FF1 passes to the "1" state, then the flip-flop FF2 follows the flip-flop FF1, and from then on the flip-flop FF3 remains in the "1" state independently until a four-bit binary counter, the flip-flop FF3 of which controls the supply at a frequency of 8c/s via a gate, has succeeded in causing its last stage to flip, after one second. During this time, the flip-flop FF1 follows any possible new changes of the switch contact; and if the flip-flop FF1 reverts to the "0" state while the flip-flop FF3 is still in the "1" state, a further flip-flop FF4 passes to the "1" state. If, subsequent to that, the contact is actuated once again, the flip-flop FF1 will again pass to the "1" state. The period measured by the counter thereupon reaches its end, and when the "1" level has passed to the output D of the counter, the balance of the state of the flip-flops FF4 and FF5 is effected. If neither of these flip-flops has changed state, that means that the contact has not been released during one second, i.e., that there was a long pulse. If the flip-flop FF4 has passed to the "1" state, but the flip-flop FF5 has remained in the "0" state, that means that the switch was released during the period in question but that it was not re-actuated. This means that there was a single short pulse of the switch. Finally, if both flip-flops FF4 and FF5 have passed to the "1" state, that means that during the period of one second, there was a release of the contact, then another actuation thereof. These three states are detected by three gates S1, S2, and S3, respectively, which supply a pulse until the counter is reset, which happens, a quarter of a second later, as soon as the element B of the binary counter has again passed to the "1" state at the same time as the element D. Therefore, the pulses LP, or Cp or DP are present for a fraction of a second before the binary counter is reset. On the other hand, it will be seen that only one of the three outputs can supply a pulse each time, the other two never being able to supply any pulse for the same order. It will be noted that if the flip-flop FF1 is in the "1" state when the flip-flop FF3 reverts to the "0" state, nothing happens since the flip-flop FF2 is also in the "1" state. The switch would first have to be released in order for a new control operation to be able to take place.

Figure 6A:
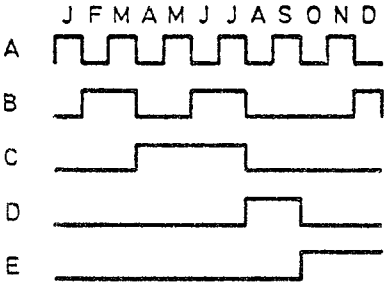
Figure 6B:
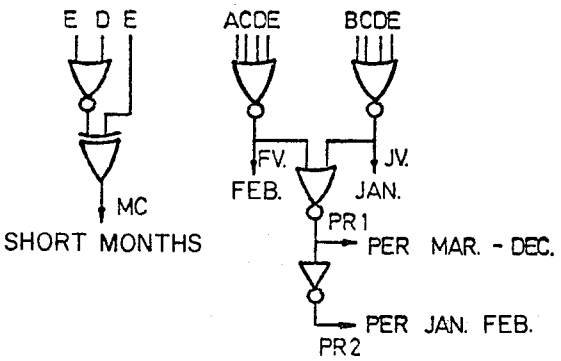

FIG. 6 illustrates the way in which the coding of the twelve months of the year takes place, precisely in five-bit counters in order to supply BCD data for the tens and the units. A counter operating according to the diagram shown in FIG. 6A is easily produced; this may be done by means of gates, by means of selective inhibitions, or in various ways known to specialists in CMOS integrated circuits (this being the technology intended for use in manufacturing the present watch). With the system shown in FIG. 6A, not only is a display in BCD quite convenient, but it is also extremely easy, as shown in FIG. 6B, to detect particular cases, e.g., all the short months (February, April, June, September, November), or also just February, or even the period March-December as opposed to the period January-February, which is necessary in order to be able to take into account the effects of the leap-years "beginning March—end February" periods mentioned in connection with FIG. 3).

FIG. 7 shows, analogously to FIG. 3, the way in which it is possible to detect the four "beginning March—end February" periods which, on account of the leap-year cycle, require the addition of different numbers of quanta to the parameters supplied by the matrix in order to obtain the desired parameters considering the annual shift by a quarter of a day. The diagram in FIG. 7A uses as a basis information prl, obtained in the manner shown in FIG. 6B. Besides that, counting stages F and G count the four-year cycle. It is evident from FIG. 7B what a very simple logical arrangement, including two exclusive OR gates, four AND gates, and two inverters, makes it possible to obtain the information concerning these four "beginning March-end February" periods.

FIG. 8 illustrates the mode of operation, and immediately suggests the type of design, of the special hour-transcoder 26, shown in FIG. 4A. The upper part of FIG. 8 shows the simple coding of a four-bit, twelve-step counter, and the lower part of FIG. 8 shows how transcoding should take place in order always to have "twelve" in place of "zero" and to able to have the tens and the units displayed separately. The curve A″ represents the first element of the following BCD stage (tens). Indicated beside the curves A′, D′, and A″ are the relatively simple logical equations which make it possible to obtain the transcoded curves starting from the original curves. These logical equations indicate to those skilled in the art beyond any possible doubt how it is possible to make up the transcoder by means of logical gates.

FIG. 9 is the transcoding diagram of the special transcoder 27 shown in FIG. 4A. Owing to the use of a strictly binary code for counting, it is possible not only to dispense with a counter stage but also—and this is important, for example, for supplying the calculator from the date-counter—to have available "quartet" information which can be obtained by taking into account only the last three bits, without having to consider the first two. For the display, on the other hand, the situation is different, and it will be obvious that in particular, the first position must necessarily be the "1" position and not the "0" position. The right-hand part of FIG. 9 shows how the transcoding may be obtained by providing five standard adder stages which transpose the "1" information, after which a conventional "five-bit binary/2×BCD" decoder may be used (function: like SN 74 185 AN, but with infinitely less consumption, being a CMOS component).

FIG. 10 shows the make-up of the reset circuits for determining the lengths of the months, taking into account the 30-year cycle of the Moslem years, already mentioned above. In FIG. 10, it should be noted that the date- and year-counters operate in the manner shown in the upper part of FIG. 9, transcoding taking place only afterwards in the special transcoder 27 of FIG. 4. Furthermore, it will be seen that with a relatively small number of gates, it is possible to detect the eleven intercalary years among the thirty of the Moslem cycle. Other than that, the diagram of FIG. 10 is explicit enough in itself for those skilled in the art and requires no extensive comment.

FIG. 11 illustrates diagrammatically, in agreement with what is shown in the lower right-hand part of FIG. 3, the manner in which the two correction-control and tables-control registers display their state by means of three tiny segments disposed in the shape of an N at the right-hand side of the watch. It will be seen that when the correction register is not at zero, it automatically energizes the cross-bar of the N. Moreover, depending upon whether it is in the positive or negative correction position, it energizes one or the other of the two uprights, causing the appearance of either an upward-pointing arrow (positive correction) or a downward-pointing arrow (negative correction). As for the register controlling the tables operating condition, which is in any case reset whenever the correction register is not itself azt zero position, it energizes either a single one of the uprights of the N or both of these uprights, thereby furnishing the diaplay I or II.

As concerns the coding of the various symbols other than the numerals which may be seen in FIG. 2, it should be noted that for the display locations which are first of all controlled in four-bit binary form (16 possibilities), it is important to reserve a possibility of causing an absence of display, for depending upon the conditions, a 0000 causes the display of a "0". The principle adopted is the following: the second-place figures, i.e., the second and fourth figures of a line, display the zero when it is present, whereas the others do not display it unless it forms part of an indication of minutes, of seconds, or of indications of local corrections. On the other hand, when two particular characters are possible at the same location of a certain item of information, e.g., C or L to indicate "common year" or "long year," it is important that the difference between the combinations controlling these characters applies to only one bit so that the other three bits can be permanently established; besides, this follows from the legends appearing in FIG. 4B at the location of the gate circuit 33.

It will also be noted that the auxiliary display location, although having seven segments, is slightly different from those usually encountered. The upper right-hand vertical segment is slanted for the purpose of more easily simulating the letter D (date). In addition, the upper and lower horizontal bars are slightly shorter than the middle horizontal bar, making it easier to simulate the letter s (south).

Finally, as concerns the display, it should be noted that there is some difficulty in displaying the letter W. This difficulty has been avoided by provided a supplementary segment at the level of the lower horizontal segments between the last two display locations at the right of the lower display line. It is only for displaying the letter W that this segment is used, as may be particularly understood from the upper left-hand part of FIG. 4A. At the same time that the transcoder 23 energizes this special segment, it gives a command to the transcoder 22 so that the latter, although receiving an order not to energize any of the segments it controls, does energize the two left-hand vertical segments of the display location situated just to the right of the special segment, and this makes it possible to obtain the configuration W as it appears, for instance, in FIGS. 2K and 2P.

The various controls brought about by the alarm circuit especially concern all the gates 28–47. Those which do not control one of the three data which the alarm causes to appear are all made non-conducting by the alarm, whereas those which must transmit information to be displayed at the time of the alarm receive a command which makes them conducting at that time (naturally only in the phase of the multiplexing cycle which corresponds to them).

Although the watch described exhibits a plurality of functions which are of interest as a whole, it would also be possible to produce the watch in a simpler embodiment comprising only some of those functions, e.g., a watch comprising only the hours which are not easy to calculate, namely, those relating directly to the sun, or possible even only those of sunrise, meridian transit, and sunset. As concerns the geographical position, it would also be possible to envisage the introduction of a matrix automatically giving the point of the principal cities of the world, such as Cairo, Teheran, Baghdad, Algiers, Paris, London, New York, San Francisco, Tokyo, etc. At present, the wearer of the watch will use a chart indicating for each city the positions to adjust for the longitude, the latitude, and the local corrections of latitude and longitude. Even without such a chart, the system described makes it possible to find the positions to enter in the registers, simply with the aid of a map.

It would not be absolutely necessary to store in the matrix the directions of Mecca for points which are not on land but rather, e.g., on the high seas. In this way, a certain number of bits could be dispensed with in the part of the memory giving the direction of Mecca.

As concerns the display M1 of the Moslem hours, it would also be possible to provide for counting of exactly 60 minutes at the beginning of the chain, or even for counting starting directly from the seconds. For that purpose, it would suffice (FIG. 3) to replace the modulo 6 counter by a 60-minute counter, or even by a cascade comprising a 60-second counter and a 60-minute counter. p A further possibility would be to provide, parallel to the bidirectional standard-time counters shown in FIG. 3, a second, analogous counter counting the minutes and the hours, or as a variation, only the hours, of a different time selected at will by the wearer (e.g., New York time when the wearer is in Paris). This different-time information might advantageously be interposed in the cycle of the upper display line between the present last position, H5, which gives the next Moslem ritual hour, and the present penultimate position, H4, which gives the years of the 30-year Moslem cycle. As a variation, this different-time information might be introduced instead in the second position of the cycle of the upper display line, the present positions H2 to H5 then being shifted down one step each.

Whenever the calculator is no longer in a position to calculate the ritual hours exactly and must keep to the indicated limits (minimum interval of three hours and maximum of nine hours for sunrise and sunset, minimum interval of two hours and maximum of seven and one-half hours for the time of the sinking sun), it might be advantageous to indicate this fact when these ritual-hour indications are displayed. For that purpose, it would be very simple just to replace the last figure of the indication (the minutes) by a dash, this replacement being made for the display but naturally not for the coincidence detection.

The watch may be still further improved by adding the possibility of causing a supplementary table to appear. This table, which may be called up in a similar way to the tables TI and TII, will give the elevation of the sun at the present moment on the top line, the elevation of the sun at meridian transit on the middle line, and the azimuth of the sun's present position on the bottom line. These values are expressed in arc degrees. The two upper values will be composed of two figures forming a whole number, followed by a point, followed by a figure representing tenths of degrees, followed by a small square standing for the degrees sign ("°"). The azimuth will be expressed in degrees counted from the north towards the east, the south, and the west; it will be indicated by a three-figure number representing a whole number of degrees followed by the same sign standing for "°". The identification symbol in the right-hand field will be a "ㄴ" (square s without its upper and lower horizontal bars) for the top line (present elevation of sun), the same symbol as for the third ritual hour (meridian transit) for the middle line (elevation of sun at meridian transit), and finally a b-shaped symbol for the bottom line (azimuth of the sun).

This table will be of great advantage, for instance, to persons who design and operate installations for the collection of solar energy, and it may also be very useful to architects who design buildings all over the world and are obliged to calculate the length of shadows cast in different locations and on different dates. As it is above all the middle indication which will be of interest to them (elevation of the sun at meridian transit), they will be able to retain just the center value of the table and cause the data or zone (latitude) indications to appear on another line in the manner described in connection with the first two tables. Under these conditions, by modifying the date or the zone displayed jointly with the meridian elevation of the sun, they will automatically cause a corresponding correction of the latter indication, a possibility which will be very convenient for their planning. On the other hand, if it is desired to know the characteristics of a shadow at some time other than true noon, it will suffice to cause the local time to appear in the middle field, and the other two indications of the supplementary table in question will make it possible to learn the size and direction of the shadow at that time (for a predetermined date and region).

The proposed watch may also be very useful to airplane pilots who continually have to find out when they will enounter sunrise or sunset during flights which take them to different latitudes and longitudes. The Moslem ritual hours corresponding to sunrise, meridian transit of the sun, and sunset will then be of great use to them. They need only adjust their watch to the zone of the location in question and they will know when the sun will rise or set there, just as they will simultaneously be able to find out the local time there automatically.

With the above-mentioned supplementary table, moreover, another variation of the watch may exhibit an interesting simplification. This will consist in replacing the two tables TI and TII of Moslem ritual hours by a single table simply giving the time of sunrise at the top, the time of the meridian transit of the sun (true noon) in the middle, and the time of sunset at the bottom. With these three indications, Moslems will already know three of their ritual hours, viz., the second, third, and fifth. To calculate the first and sixth, they have only to subtract or add an hour and a half with respect to the second or fifth, respectively. Finally, to learn the fourth ritual hour at least approximately, they may adopt the following very simple rule based upon the indication of the elevation of the sun at meridian transit: if the elevation is less then 30°, the fourth ritual hour will be one-third of the way through the afternoon; if the elevation is between 30° and 45°, the fourth hour will be in the middle of the afternoon; if the elevation is between 45° and 70°, the fourth ritual hour will be two-thirds of the way through the afternoon; and if the elevation is greater than 70°, the fourth ritual hour will be three-quarters of the way through the afternoon. In this context, afternoon is understood to comprise the period between the sun's meridian transit and sunset.

In such a case, both the alarm function and the indication of the next ritual hour are eliminated. The function H9, indicating the next ritual hour, is preferably replaced by the display of the sun's elevation at the present moment. By leaving this indication in function, the Moslem can recognize the second ritual hour (the elevation of the sun ceasing to be zero), the third ritual hour (the elevation of the sun ceasing to increase and starting to decrease, or the elevation of the sun equalling the elevation of the sun at meridian transit, indicated in the table), the fourth ritual hour (elevation of the sun equal to 26.5°), and the fifth ritual hour (the elevation of the sun becoming zero). The first and sixth ritual hours can also easily be shown by the fact that from sunset to the sixth ritual hour and from the first ritual hour to sunrise, the elevation indicated will be 00.0°, while during the rest of the night it will be 0.0°.

With this solution, it will be preferable to add a third position to the middle display cycle in order to repeat the indication of the geographic zone, so that a pilot, having introduced the time of sunrise on the top line and the time of sunset on the bottom line by means of the table TI, can cause the local time and the zone in question to appear on the middle line. By effecting a correction of zone, he will bring about corresponding modifications of the displayed times of sunrise and sunset.

In a still further simplified version, the indication of the direction of Mecca might be eliminated. In this case, it would be preferable to put the indication of the seconds at the end of the bottom cycle of indications, after the date and geographical indications.

Finally, in a last version intended more for pilots, for example, than typically for Moslems, the watch would no longer exhibit the cycle of indications of the Moslem calendar, nor the indication of Moslem time. The date indications (date and month, day of the week, year) will then preferably be assigned to the positions H2 to H4, and the geographical indications, latitude and longitude, fine latitude, fine longitude, to the positions B2 to B4. As for the position M1, it would be preferable to repeat there the seconds information which never need appear in the tables but which it would be of interest to be able to present separately, without any other indications on the watch, for greater convenience in carrying out timing operations, for instance, requiring rapid and accurate reading of the running seconds.

With such a watch, an architect who had caused the supplementary table to appear (now on the second table) could retain there only the indication of the elevation of the sun at meridian transit, on the middle line, and he could cause the date (including the month) to be displayed on the top line and the zone (latitude and longitude) to be displayed on the bottom line.

The three indications proposed as variations, viz., the elevation of the sun at meridian transit, the present elevation of the sun, and the present azimuth of the sun, are very easily determined. It has been seen that the elevation of the sun at meridian transit is equal to $\alpha-\lambda$, $\alpha$ being given by the matrix for the indicated orbital position and $\lambda$ being the longitude. As for the azimuth angle, it is easily calculated starting from the position of true noon, given by the matrix, by counting 1° of arc per 4 min., true noon being at 180°. Finally, the present elevation of the sun is easily calculated by the calculator on the basis of previously acquired data; it will be equivalent to $$\alpha-90^\circ-(90^\circ-\lambda)\cos\tau$$

$\tau$ being the azimuth angle of the sun, counted from the north, like its display.

For the calculation of $\alpha$, the co-ordinates of date and plate will be taken, as indicated in the part of this description relating thereto. In order to account for the oribital path during the fractions of a day in the case of the "present elevation of the sun," one quantum will be added if the present time is more than 1 hr. 30 min. after true noon, two quanta if it is more than 4 hr. 30 min. after true noon, and three quanta if it is more than 7 hr. 30 min. after true noon. Conversely, one, two, or three quanta will be subtracted when the present time precedes true noon by more than 1 hr. 30 min., 4 hr. 30 min., or 7 hr. 30 min., respectively.

Therefore, among other possibilities still existing within the scope of the present invention, the proposed watch can be produced in three variations, one typically intended for Moslems, the second intended for both Moslems and pilots, and the third typically intended for pilots. It will be noted that with this last version, the Moslem can still easily recognize his ritual hours nonetheless, owing to the indication of the present elevation of the sun. For the non-Moslem, the moment when the indication passes from 0.0° to 00.0°, and vice versa, will approximately correspond to the beginning of dawn (1 hr. 30 min. before sunrise) and the end of dusk (1 hr. 30 min. after sunset), respectively.

What is claimed is:

1. A timepiece comprising, in combination:

clock means for keeping standard time and generating first data representative thereof;

input means for inputting second data representative of a longitudinal position and a latitudinal position on the earth; ;p1 calculator means, responsive to said clock means and said input means, for generating third data representative of a series of times when the sun occupies, respectively, a series of predetermined positions relative to said longitudinal position, said latitudinal position, and the time of year as kept by said clock means; and display means, responsive to said calculator means, for numerically displaying said times.

2. A timepiece as claimed in claim 1 wherein said series of times includes the time 90 minutes before sunrise, the time of sunrise, the time when the sun passes the meridian, the time of sunset and the time 90 minutes after sunset.

3. A timepiece as claimed in claim 1 wherein said display means includes three display lines, each of said three display lines being capable of displaying four characters.

4. A timepiece as claimed in claim 3 wherein one of said three display lines displays standard time as kept by said clock means.

5. A timepiece as claimed in claim 1 or claim 3 wherein said input means includes control means for selectively activating said display means to display a select one of said series of times.

6. A timepiece as claim in claim 5 wherein said control means permits actuation of said display means, such that three of said times are simultaneously displayed on said three line displays, respectively.

7. A timepiece as claimed in claim 5 wherein said display means further displays an identifying symbol in proximity to said select one of said times.

8. A timepiece as claimed in claim 7 wherein said calculator means actuates said display means so as to flash said identifying symbol associated with an upcoming time of said series.

9. A timepiece as claimed in claim 7 wherein said calculator means further includes detection means for comparing said first data and said third data and for flashingly activating said display means whenever said first data and said third data correspond, whereby said display means flashes said time and said symbol, so as to indicate the presence of the sun at one of said predetermined positions.

10. A timepiece as claimed in claim 1 wherein said calculator means further generates fourth data, in response to said input means, representative of a direction to a predetermined location on each from said longitudinal position and said latitudinal position, and said display means displays said direction in response to said calculator means.

11. A timepiece as claimed in claim 1 wherein said calculator means further generates fifth data, in response to said clock means and said input means, representative of Moslem time.

* * * * *